US007207513B2

(12) United States Patent
Tessier et al.

(10) Patent No.: US 7,207,513 B2
(45) Date of Patent: Apr. 24, 2007

(54) DEVICE AND METHOD FOR COMMINUTING MATERIALS

(75) Inventors: Lynn P. Tessier, Cochrane (CA); Russell M. Graham, Calgary (CA); James B. Graham, Cochrane (CA); William D. Burke, High River (CA); Fan Jiang, Calgary (CA)

(73) Assignee: Aerosion Ltd., Aldersyde, Alberta (CA)

( * ) Notice: Subject to any disclaimer, the term of this patent is extended or adjusted under 35 U.S.C. 154(b) by 44 days.

(21) Appl. No.: 10/644,654

(22) Filed: Aug. 20, 2003

(65) Prior Publication Data

US 2004/0113002 A1 Jun. 17, 2004

Related U.S. Application Data

(63) Continuation-in-part of application No. 10/042,052, filed on Oct. 18, 2001, now abandoned.

(60) Provisional application No. 60/480,907, filed on Jun. 23, 2003.

(51) Int. Cl.
*B02C 19/00* (2006.01)

(52) U.S. Cl. ..... 241/275

(58) Field of Classification Search ..... 241/275, 241/277, 5, 40, 86.1, 300
See application file for complete search history.

(56) References Cited

U.S. PATENT DOCUMENTS

| | | | |
|---|---|---|---|
| 948,129 | A | 2/1910 | Bilz |
| 2,448,049 | A | 8/1948 | Rafton |
| 2,507,166 | A | 5/1950 | Lehman |
| 3,146,958 | A | 9/1964 | Wallace, Jr. |
| 3,552,662 | A | 1/1971 | Grob |
| 3,659,794 | A | 5/1972 | Hemesath |
| 3,675,373 | A | 7/1972 | Putnam |

(Continued)

FOREIGN PATENT DOCUMENTS

| | | | |
|---|---|---|---|
| DE | 576895 | C | 5/1933 |

(Continued)

OTHER PUBLICATIONS

PCT International Search Report, PCT/CA02/01588, Jan. 29, 2003.

(Continued)

*Primary Examiner*—Mark Rosenbaum
(74) *Attorney, Agent, or Firm*—Sean W. Goodwin

(57) ABSTRACT

The present invention provides a comminuting device that can generate an impact speed exceeding 200 ft/s, for example 1,500 ft/s, while consuming less energy than conventional comminuting devices, and thus, is more efficient than conventional comminuting devices. The comminuting device comprises a throwing wheel that generates a centrifugal and tangential force in the particles of material to accelerate the particles toward a desired impact speed, an impact rotor that includes an impact surface to fragment the particles when the particles collide with the impact surface, and a motor operable to power the impact rotor and the throwing wheel. To increase the impact speed of the particle, the impact surface is moved toward the particle as the particle exits the throwing wheel. Thus, the comminuting device can generate impact speeds that exceed the impact speeds generated by conventional comminuting devices and consequently fracture a particle into smaller pieces after one run.

13 Claims, 7 Drawing Sheets

U.S. PATENT DOCUMENTS

| | | | | | |
|---|---|---|---|---|---|
| 3,688,991 | A | | 9/1972 | Andrews | |
| 3,815,833 | A | | 6/1974 | Vliet et al. | |
| 3,973,733 | A | | 8/1976 | Switzer | |
| 3,982,702 | A | | 9/1976 | Barnhart et al. | |
| 4,061,279 | A | * | 12/1977 | Sautter | 241/86.1 |
| 4,126,280 | A | | 11/1978 | Burk | |
| 4,280,665 | A | | 7/1981 | Adams, III et al. | |
| 4,504,017 | A | | 3/1985 | Andrews | |
| 4,690,341 | A | * | 9/1987 | Hise et al. | 241/275 |
| 4,892,261 | A | | 1/1990 | Rolle et al. | |
| 5,248,101 | A | | 9/1993 | Rose et al. | |
| 5,513,811 | A | | 5/1996 | Phan Hung | |
| 5,769,693 | A | | 6/1998 | Wadephul | |
| 5,836,369 | A | | 11/1998 | Renner et al. | |
| 6,092,749 | A | | 7/2000 | Stegmeier | |
| 6,227,472 | B1 | | 5/2001 | Ryan et al. | |

FOREIGN PATENT DOCUMENTS

| | | | | | |
|---|---|---|---|---|---|
| DE | 11 49 229 | B | | 5/1963 | |
| FR | 2538718 | A1 | * | 7/1984 | 241/275 |
| WO | WO 96/32196 | A | | 10/1996 | |

OTHER PUBLICATIONS

International Search Report dated Aug. 24, 2004 to PCT/CA2004/000934.

* cited by examiner

DEVICE AND METHOD FOR COMMINUTING MATERIALS

CROSS REFERENCE TO RELATED APPLICATIONS

This application is a Continuation-In-Part of the commonly owned U.S. patent application Ser. No. 10/042,052, filed 18 Oct. 2001, titled "APPARATUS AND METHODS FOR COMMINUTING MATERIALS", now abandoned, which is hereby incorporated by reference in its entirety. This application also claims priority from commonly owned U.S. Provisional Patent Application No. 60/480,907, filed 23 Jun. 2003, titled "DEVICE FOR COMMINUTING MATERIALS", presently pending, which is hereby incorporated by reference in its entirety.

BACKGROUND

Many different types of material are comminuted, i.e., the size of the material's particulates are reduced, for a variety of different reasons. For example, coal excavated from a mine is frequently comminuted to make the particulate size smaller and more uniform to facilitate the coal's transportion and/or to provide consistent combustion in a furnance. Food stuffs, such as wheat, are frequently comminuted to produce flour. And rock containing a desirable ore is frequently comminuted to provide easier access to the ore and the metal included in the ore.

A common way of comminuting material is to collide a particle of the material with an impact surface. The collision generates a force on and inside the particle that causes the particle to fracture into two or more smaller pieces. The amount of force generated in the collision is directly proportional to the impact speed of the particle—the speed of the particle relative to the impact surface at the moment of collision—and increases as the impact speed increases. As the amount of force generated on and inside the particle increases, the size of the pieces that result from the collision of the particle with the impact surface decreases.

There are many different comminuting devices that collide a particle of material with an impact surface. For example, Hammer mills comminute particles of material with a rotating set of hammers having impact surfaces. In operation, the material is dropped into the mill and fed by gravity to the hammers. The hammers smash the particles of the material into smaller pieces and also throw some of the particles and pieces against a side of the mill. In a hammer mill the impact speed of the particles largely depends on the rotational speed of the hammers.

Another type of comminuting device is a pin mill. The pin mill comminutes particles of material with multiple rings of pins spinning in opposite directions. In operation, the material is dropped into the center of the mill and moves outward through the paths of the pins in each ring. As the particles of material move, the pins knock the particles. In a pin mill, the impact speed of the particles largely depends on the speed of the pins moving along the paths.

Another type of comminuting device is a jet mill. Jet mills comminute particles by accelerating the particles with a jet of air and directing the accelerated particles against an impact surface, which may or may not be stationary, or against an opposing jet of particles. In operation, a jet of air is generated and the particle is then fed into the jet to accelerate it. Once accelerated to a desired speed, the particle is directed toward and collides with the impact surface or another particle of an opposing jet. In a jet mill, when the impact surface is stationary, the impact speed of a particle largely depends on the speed of the particle, and when the impact surface moves, or an opposing jet of particles is used, the impact speed of a particle largely depends on the combined speed of the particle and the impact surface or particle of the opposing jet.

Unfortunately, each of these comminuting devices has some problems. Each of these devices is not very efficient for comminuting many types of material, i.e., a comparison of the amount of energy these devices consume to comminute a material with the value of the material at a given particulate size. Each comminuting device consumes a substantial amount of energy to comminute a material to a desired particulate size. Because hammer and pin mills typically generate a maximum impact speed of about 350 ft/sec compared to an impact speed of about 550 ft/sec or more, which is typically desired for efficient comminution, as indicated in tests, a significant reduction in a material's particulate size typically requires the material to be run through these mills more than once. Thus, the amount of energy consumed during the comminuting process includes the amount of energy required to operate these mills during multiple runs. Furthermore, to generate a higher impact speed (greater than about 550 ft/sec), the hammers and pins would have to rotate/move faster than their conventional structures will allow without sustaining substantial wear or catastrophic failure. Although jet mills can generate higher impact speeds than hammer and pin mills, the amount of energy jet mills consume can also be significant because they generate a jet of air to accelerate a particle, which typically requires a substantial amount of energy.

SUMMARY

The present invention provides a comminuting device that can generate an impact speed exceeding 200 ft/s while consuming less energy than conventional comminuting devices, and thus, is more efficient than conventional comminuting devices. For example, the comminuting device may generate an impact speed of about 1,500 ft/s. The comminuting device comprises a throwing wheel that generates centrifugal and tangential forces in particles of material to accelerate the particles toward a desired impact speed, an impact rotor that includes an impact surface to fragment the particles when the particles collide with the impact surface, and a motor operable to power the impact rotor and the throwing wheel. To increase the impact speed of the particle, the impact surface is moved toward the particle as the particle exits the throwing wheel. Thus, the comminuting device can generate impact speeds that exceed the impact speeds generated by conventional comminuting devices and consequently fracture a particle into smaller pieces after one run. Furthermore, because the throwing wheel uses centrifugal force to accelerate the particle toward the impact speed, the comminuting device consumes less energy during the acceleration of the particle than a conventional jet mill. Consequently, the comminuting device can generate greater impact speeds with less energy than conventional comminuting devices.

In one aspect of the invention, the throwing wheel comprises a center through which a wheel axis passes, a periphery, a hub located at the center to receive particles of material, and a channel extending from the hub toward the periphery to direct the particles of material from the wheel hub toward the periphery. When the throwing wheel rotates about the wheel axis, the wheel exerts a tangential force on a particle received in the hub, and the particle accelerates toward the periphery by centrifugal force. At the periphery, the particle exits the throwing wheel on a trajectory. The particle's trajectory may be modified by changing the direction that the channel extends from the hub toward the periphery. For example, the channel may extend from the hub in a straight or substantially straight direction and intersect the periphery at about 90°. Or the channel may extend from the hub in a straight or substantially straight direction and intersect the periphery at an angle other than 90°. Or the channel may extend from the hub in a curved direction. By modifying the particle's trajectory, one may increase or decrease, as desired, the impact speed of the particle.

In another aspect of the invention, the impact rotor comprises a body including a rotor axis about which the impact rotor rotates when a motor powers the impact rotor, and a peripheral region located a radial distance away from the rotor axis. The impact rotor also comprises a plurality of impact teeth, each extending from the peripheral region and each including an impact surface to fragment particles of material when the particles collide with the impact surface. Each impact surface is angularly positioned relative to the rotor axis and a radius perpendicularly extending from the rotor axis toward the impact surface to increase the force generated in a particle at the moment of collision. For example, to maximize the particle's impact speed, the impact surface is angularly positioned to be perpendicular with the particle's trajectory at the moment of collision. The impact teeth may be removable from the impact rotor to allow one to remove and replace a worn or otherwise undesirable impact surface. Furthermore each impact surface may be removable from their respective impact tooth.

In yet another aspect of the invention, the comminuting device may include two or more impact rotors each sized to revolve their respective impact surface on a circular path about a common rotor axis with the two or more circular paths being concentric with each other. To sustain a high impact speed for a particle that collides with the outer impact surface, the impact rotors may rotate in directions opposite their adjacent impact rotor.

DETAILED DESCRIPTION

The following discussion is presented to enable one skilled in the art to make and use the invention. Various modifications to the disclosed embodiments will be readily apparent to those skilled in the art, and the generic principles herein may be applied to other embodiments and applications without departing from the spirit and scope of the present invention as defined by the appended claims. Thus, the present invention is not intended to be limited to the embodiments shown, but is to be accorded the widest scope consistent with the principles and features disclosed herein.

Figure 1:
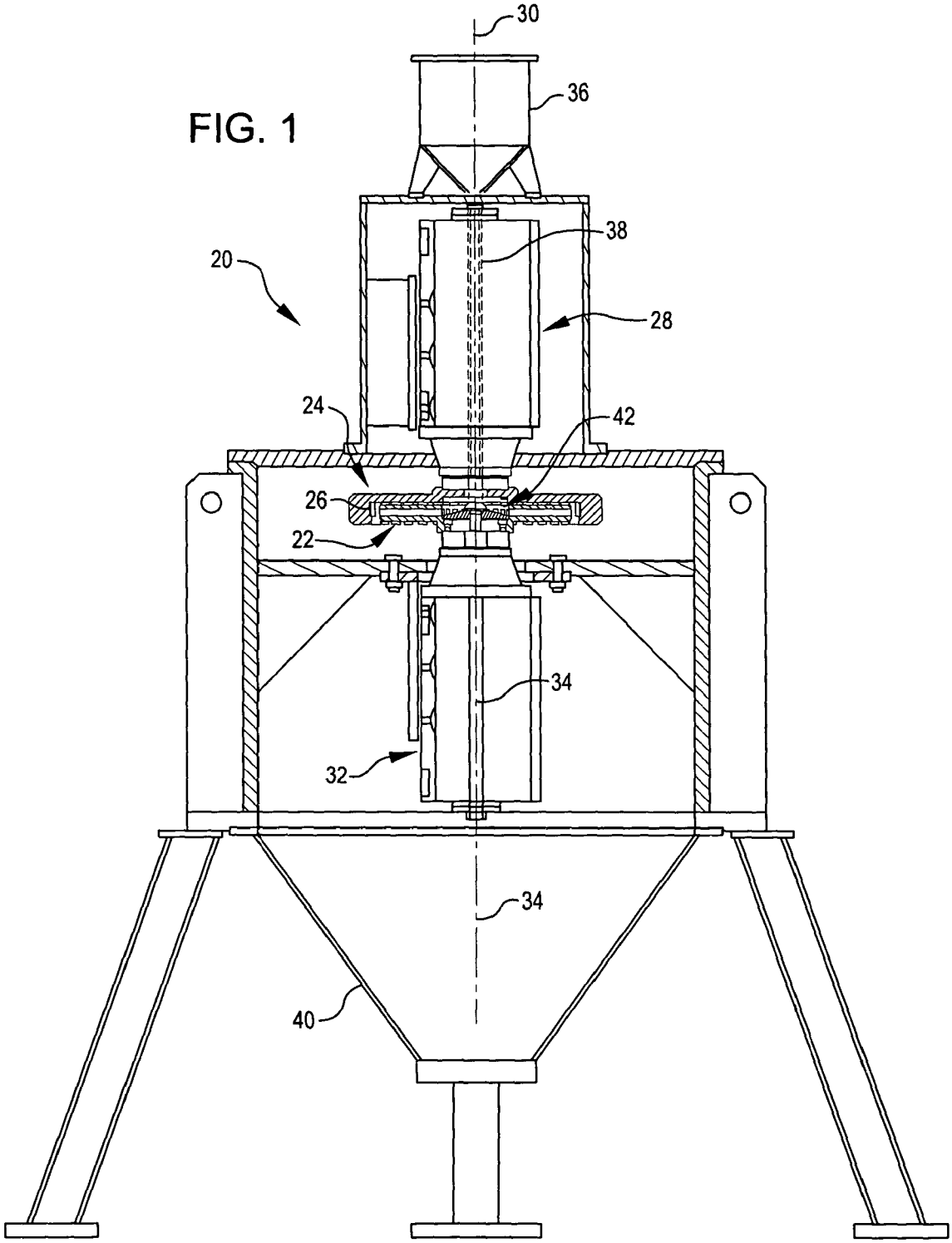
FIG. 1 is a partial cross-sectional view of a comminuting device according to an embodiment of the invention.

FIG. 1 is a partial cross-sectional view of a comminuting device 20 according to an embodiment of the invention. The comminuting device 20 includes a throwing wheel 22 (discussed in greater detail in conjunction with FIGS. 2A and 3) to accelerate particles of material (omitted for clarity) toward an impact speed, and an impact rotor 24 (also discussed in greater detail in conjunction with FIGS. 2A and 5) that includes an impact surface 26 (shown more clearly in FIGS. 2A and 5) to fragment particles that collide with the impact surface 26 after exiting the throwing wheel 22. The comminuting device 20 also includes a motor 28 to rotate the impact rotor 24 about a rotor axis 30 and another motor 32 to rotate the throwing wheel 22 about a wheel axis 34 in a direction opposite to the rotation of the impact rotor 24. In addition, the comminuting device 20 includes an inlet hopper 36 to receive particles of material, a conduit 38 to direct the particles of material from the hopper 36 to the throwing wheel 22, and an outlet hopper 40 to collect processed material.

By rotating the throwing wheel 22 and the impact rotor 24 in opposite directions, the impact speed of the particles become a combination of the particles' speed and the impact surface's speed. If, at the moment of collision, the trajectory of the particle is aligned but opposite the trajectory of the impact surface 26, then the particle's impact speed will be the sum of the particle's speed and the impact surface's speed. Thus, the comminuting device 20 may generate impact speeds exceeding those generated by conventional comminuting devices. This increase in impact speed combined with an orientation of the impact surface 26 that aligns the direction of the impact surface 26 with the trajectory of the particles increases the force generated on and in the particles at the moment of collision. Consequently, particles of the material may be fragmented into smaller pieces after one run through the comminuting device 20, which allows the comminuting device 20 to comminute material more efficiently.

Still referring to FIG. 1, in operation the comminuting device 20 uses tangential and centrifugal force to accelerate particles of material toward an impact speed. First, material is poured in the hopper 36 and flows through the conduit 38 to a hub 42 (discussed in greater detail in conjunction with FIGS. 2A and 3) of the throwing wheel 22. The conduit 38 may include a valve (not shown) to allow one to control the flow rate of the material to the throwing wheel 22. Once particles enter the hub 42, the rotation of the throwing wheel 22 exerts a tangential force on the particles and generates centrifugal force in each particle that propels each particle radially away from the hub 42 toward an exit of the throwing wheel 22. As each particle moves away from the hub 42, the tangential and centrifugal forces accelerate the particles toward an impact speed. Upon exiting the throwing wheel 22, each particle continues to move on a trajectory and then collides with an impact surface 26 of the impact rotor 22 that is moving toward the particles. After colliding with the impact surface 22, the particles and/or fragments of the particles may collide with other portions of the impact rotor 24 and/or throwing wheel 22 but eventually fall into the hopper 40.

Figure 2A:
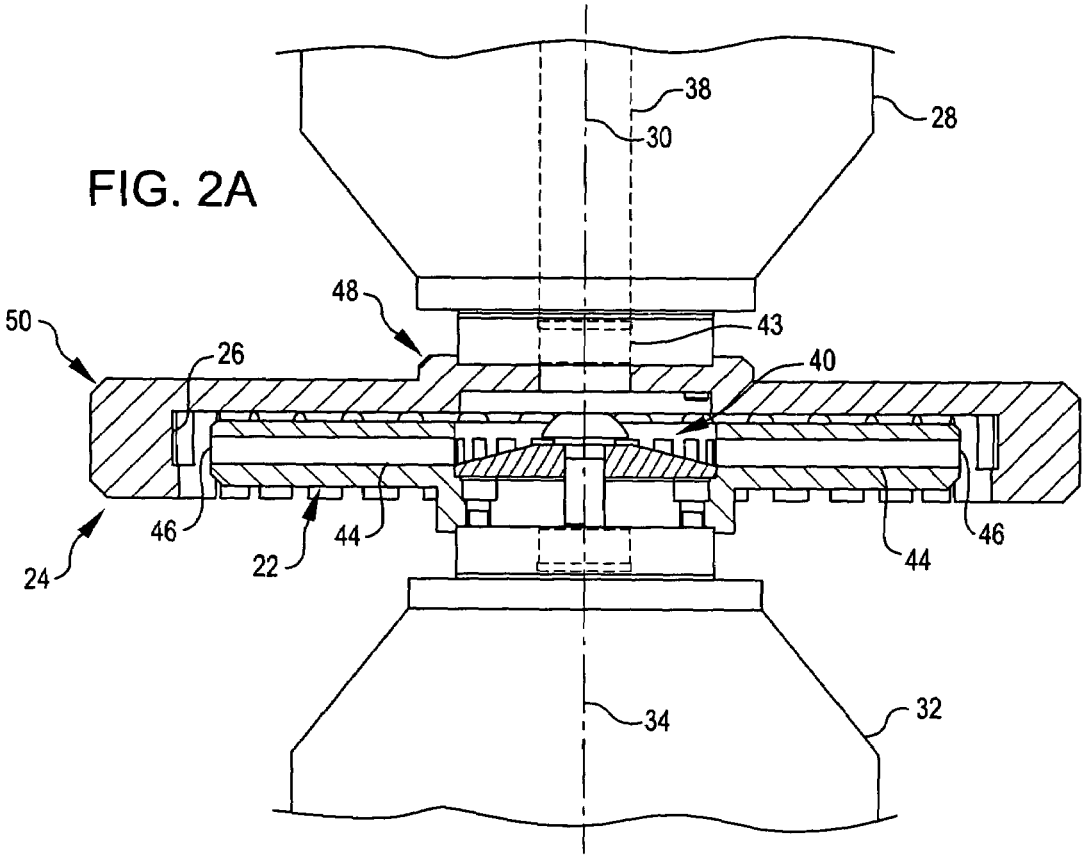
FIG. 2A is a larger view of the cross-sectional view in FIG. 1 of a throwing wheel and impact rotor incorporated in the comminuting device, according to an embodiment of the invention.

FIG. 2A is a larger view of the cross-sectional view in FIG. 1 of the throwing wheel 22 and the impact rotor 24 incorporated in the comminuting device 20 (FIG. 1).

In one embodiment, the throwing wheel 22 and the impact rotor 24 are mounted in the comminuting device 20 such that the wheel axis 34 and the rotor axis 30 are aligned or substantially aligned. The throwing wheel 22 may be mounted to the motor 32 using any desired fastening technique such as bolts and nuts, and the impact rotor 24 may be mounted to the motor 28 likewise. The motors 32 and 28 may be any desired motor, for example an electric motor designed to power their respective throwing wheel 22 and impact rotor 24 at a desired rotational speed for a given material flow rate through the comminuting device 20.

Still referring to FIG. 2A, in one embodiment, the hub 42 of the throwing wheel 22 may receive particles of material through a hole 43 in the impact rotor 24 via the conduit 38. The throwing wheel 22 may also include a channel 44 to direct the particles of material from the hub 42 toward a periphery of the wheel 22 where a wheel exit 46 is located, as the particles accelerate toward an impact speed. Because the throwing wheel 22 generates centrifugal force that accelerates the particles by rotating about the wheel axis 34, the amount of energy required to accelerate each particle toward an impact speed is less than the amount of energy frequently required by conventional comminuting devices.

Still referring to FIG. 2A, in one embodiment, the impact rotor 24 may include a rotor hub 48 having the hole 43 that allows the particles of material to enter the throwing wheel's hub 42 from the conduit 38. In addition, the impact rotor 24 may include a rotor periphery 50 where the impact surface 26 is located. When the impact rotor 24 rotates about the rotor axis 30, the impact surface revolves around the throwing wheel 22 in a circular path. Thus, after a particle leaves the throwing wheel 22 through the exit 46, the particle and the impact surface 26 collide to fragment the particle into smaller pieces.

Figure 2B:
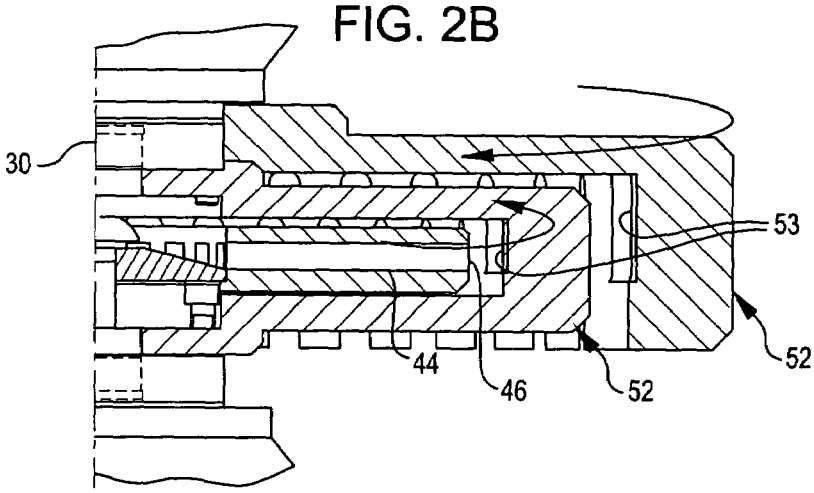
FIG. 2B is a cross-sectional view of a comminuting device according to another embodiment of the invention that incorporates a throwing wheel and two impact rotors.

Other embodiments of the comminuting device are contemplated. For example, the comminuting device may include two or more impact rotors 52 as shown in FIG. 2B. Each impact rotor 52 may include an impact surface 53 that each respective rotor 52 revolves on a respective circular path about the rotor axis 30. Each circular path may be concentric with the other circular paths and the rotational direction of an impact rotor 52 may be opposite the rotational direction of an adjacent impact rotor 52. Another embodiment of the comminuting device may include the throwing wheel 22 and impact rotor 24 mounted in the comminuting device 20 such that the wheel axis 34 and the rotor axis 30 are not substantially aligned.

Figure 3:
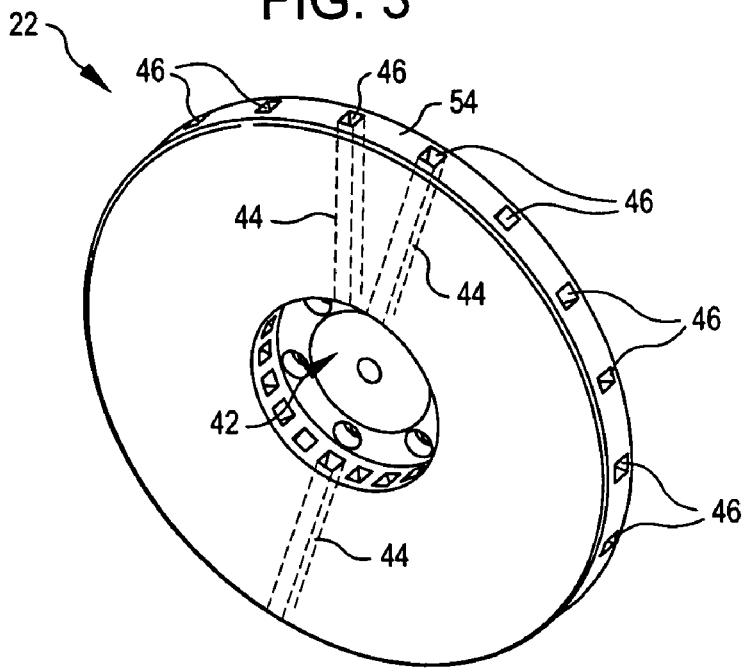
FIG. 3 is a perspective view of the throwing wheel in FIGS. 1, 2A and 2B, according to an embodiment of the invention.

FIG. 3 is a perspective view of the throwing wheel 22 in FIGS. 1, 2A and 2B, according to an embodiment of the invention. The throwing wheel 22 accelerates particles of material toward an impact speed and throws the particles from an exit 46 on a trajectory away from the wheel 22. To increase the impact speed of the particle, the throwing wheel 22 is designed to throw the particles on a trajectory that is aligned with or is as closely aligned as possible with the direction of the impact surface 26 (FIGS. 1 and 2) at the moment of collision.

When a particle leaves the throwing wheel 22 through an exit 46, the trajectory of the particle includes a directional component that is tangent to the periphery 54 and another directional component that is radial to the hub 42. The magnitude of each of these directional components depends on the velocity and acceleration of the particle as the particle leaves the wheel 22. By modifying the direction of each channel 44 as they extend toward the periphery 54, and the angle that each channel 44 intersects the periphery 54, one can modify the two directional components of the particle's trajectory.

In one embodiment, the throwing wheel 22 includes 20 channels 44 (only three shown for clarity) that extend from the hub 42 toward the periphery 54 in a straight or substantially straight direction and intersect the periphery 54 at about 90°. Each channel 44 may have any desired cross-section, such as a rectangular cross-section as shown in FIG. 3 or a circular cross-section, and may include a protective coating to mitigate the abrasive damage accelerating the particles in each channel 44 can cause. Furthermore, the throwing wheel 22 may have any desired diameter and may be made from any desired material capable of withstanding the stresses associated with rotating at a large number of revolutions per minute. For example, the throwing wheel may have a diameter of 16.5 inches and may be made of En grade 30B carbon steel (English designation) or its approximate U.S. equivalent, AISI grade 4340 carbon steel.

Figure 4A:
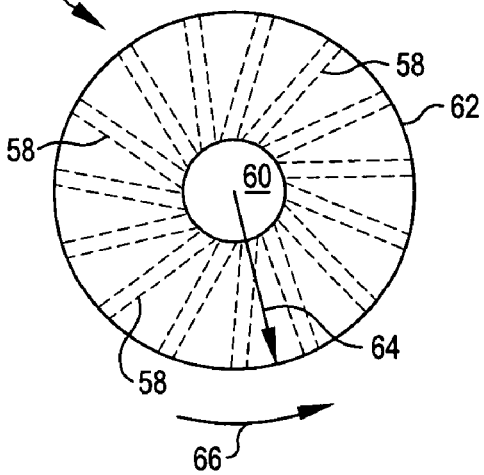
FIG. 4A is a perspective view of a throwing wheel, according to another embodiment of the invention.
Figure 4B:
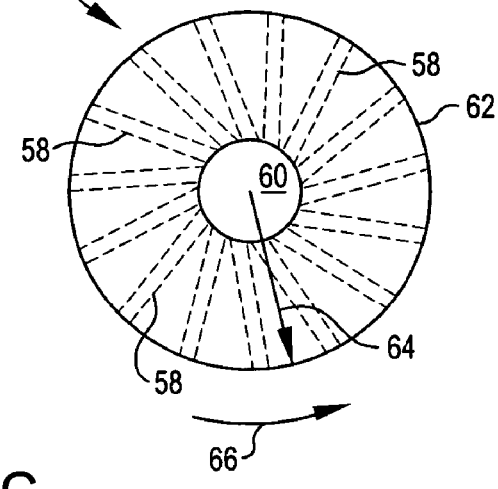
FIG. 4B is a perspective view of a throwing wheel, according to still another embodiment of the invention.
Figure 4C:
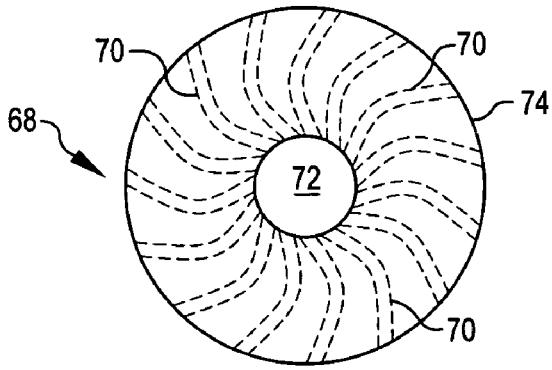
FIG. 4C is a perspective view of a throwing wheel, according to yet another embodiment of the invention.

Other embodiments of the throwing wheel 22 are contemplated. For example, in FIGS. 4A, 4B and 4C, three other embodiments of the throwing wheel 22 are shown. As shown in FIGS. 4A, and 4B the throwing wheel 56 may include channels 58 that each extend from the hub 60 in a straight or substantially straight direction toward the periphery 62 and intersect the periphery 62 at an angle not 90°. As shown in FIG. 4A, each channel 58 may be canted relative to a radius 64 of the throwing wheel 56 and away from the direction 66 that the throwing wheel 56 rotates. As shown in FIG. 4B, each channel 58 may be canted relative to a radius 64 of the throwing wheel 56 and toward the direction 66 that the throwing wheel 56 rotates. And as shown in FIG. 4C, the throwing wheel 68 may include channels 70 that each extend from the hub 72 in a curved direction toward the periphery 74 and may or may not intersect the periphery 74 at 90°.

Figure 5:
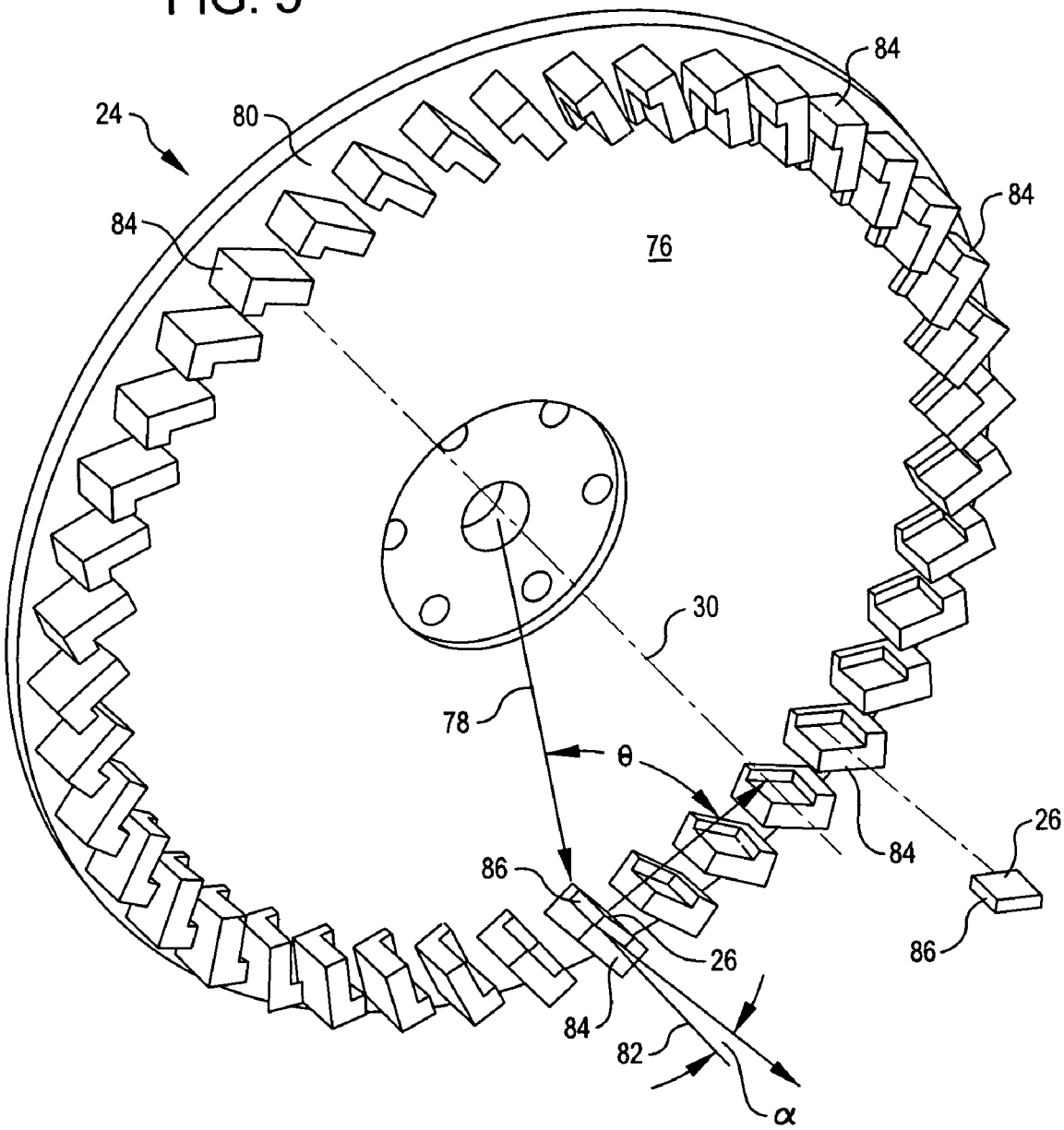
FIG. 5 is a perspective view of the impact rotor in FIGS. 1 and 2A, according to an embodiment of the invention.

FIG. 5 is a perspective view of the impact rotor 24 in FIGS. 1 and 2, according to an embodiment of the invention. The impact rotor 24 includes a plurality of impact surfaces 26 (only two shown for clarity) to fragment particles that they collide with after the particles have been accelerated by the throwing wheel 22 (FIG. 3). To increase the impact speed of the particle, the impact rotor 24 is designed to move an impact surface 26 toward particles that have left the throwing wheel 22. Furthermore, the orientation of each impact surface 26 on the impact rotor 24 is designed to align the direction of the impact surface 26 with the trajectory of the particle at the moment of collision. By increasing the impact speed of the particle and aligning the direction of the impact surfaces with the trajectory of the particle, the comminuting device 20 (FIG. 1) may generate a force on and in a particle at the moment of collision that exceeds the force generated by conventional comminuting devices.

The impact rotor 24 includes a body 76 that may be any desired shape, and each impact surface 26 may be located, as desired, and angularly positioned, as desired, relative to the rotor axis 30 and a respective radius 78 (only one shown for clarity) that extends perpendicularly from the rotor axis 30. For example, to maximize the particle's impact speed, each impact surface 26 should be perpendicular with the particle's trajectory at the moment of collision. The angular position relative to the rotor axis 30 is identified as $\alpha$, and the angular position relative to the radius 78 is identified as $\theta$ (the line 82 is parallel with the rotor axis 30). In one embodiment, the body 76 may be a circular disk having a peripheral region 80 defined between the radii 9.12 inches and 11.0 inches away from the rotor axis 30. Each impact surface 26 may be located at the peripheral region 80 and may be angularly positioned such that $\alpha$ is about 0°, and $\theta$ is about 56°. In other embodiments, however, the angular position of each impact surface 26 may be defined within a range of $\alpha$ and a range of $\theta$. For example, $\alpha$ and $\theta$ may range between 0° and 90°.

Still referring to FIG. 5, the impact rotor 24 may comprise a plurality of impact teeth 84, and a plurality of impact plates 86 (only one shown for clarity) each including an impact surface 26. In one embodiment, the impact rotor 24 includes 40 impact teeth 84 and 40 impact plates 86 (only two shown for clarity). Each impact tooth 84 may extend from the peripheral region 80 in a direction parallel or substantially parallel with the rotor axis 30, and may be an integral part of the body 76 or may be mounted to the body 76 using any desired fastening technique. For example, each tooth 84 may be mounted with a bolt and nut (not shown). Each impact plate 86 may be mounted to a respective one of the impact teeth 84 by any fastening means desired that is capable of retaining the impact plate 86 to its respective impact tooth 84. For example, each impact plate 86 may be glued to their respective impact teeth with conventional adhesive such as Loclite® manufactured by Henkel Technologies. Each impact surface 26 may be curved or flat as desired. For example, each impact surface 26 is flat or substantially flat.

Other embodiments are contemplated. For example, the impact rotor 24 may not include impact plates 86, and instead, each impact tooth 84 may include an impact surface 26 that may or may not be hardened depending on the material to be comminuted. In addition, each impact tooth may extend from the peripheral region 80 of the body 76 in other directions as shown and discussed in FIGS. 7A and 7B. Also, each impact plate 86 may be mounted to a respective one of the impact teeth 84 by inserting a protrusion or boss of the impact plate 86 into a receptacle of the respective impact tooth 84. In this type of mounting arrangement, the receptacle retains the protrusion or boss to prevent the impact plate 86 from separating from the impact tooth 84. This may be desirable to make the impact plate easier to remove and replace with a different type of impact plate.

Still referring to FIG. 5, the body 76, impact teeth 84 and impact plates 86 may be made of any desired material tough enough to withstand many collisions with particles of material without sustaining significant wear and to withstand the stresses generated in the body 76, teeth 84 and plates 86 during operation. For example, in one embodiment, the body 76 and the teeth 84 may be made of En grade 30B carbon steel (English designation) or its approximate U.S. equivalent, AISI grade 4340 carbon steel, and each impact plate 86 may be made of a cemented carbide, such as tungsten carbide, a carbon steel that has been case hardened or that includes a thick-film diamond coating, or a ceramic that includes a metal compound.

Figure 6A:
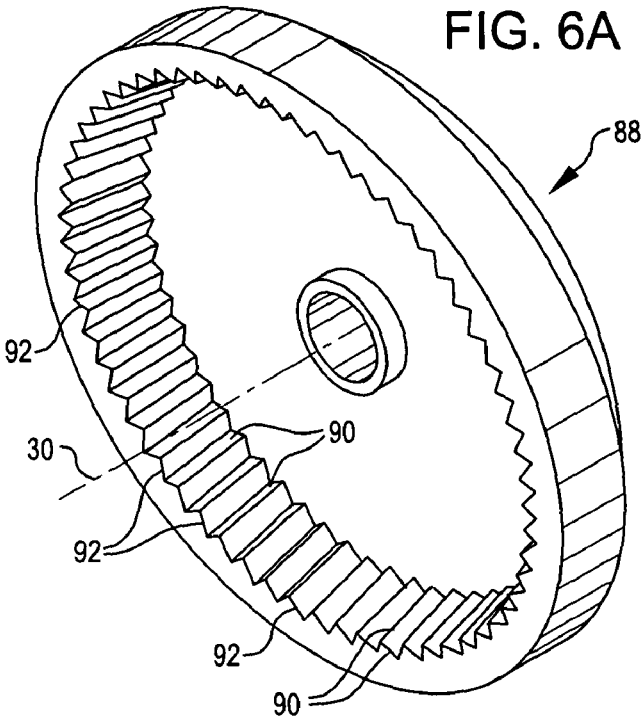
FIG. 6A is a perspective view of an impact rotor, according to another embodiment of the invention.
Figure 6B:
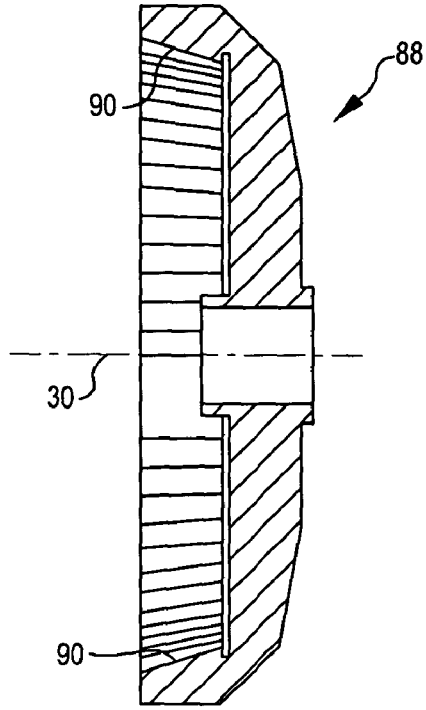
FIG. 6B is a cross-sectional view of the impact rotor in FIG. 6A.

FIGS. 6A and 6B are views of an impact rotor 88, according to another embodiment of the invention. FIG. 6A is a perspective view of the impact rotor 88, and FIG. 6B is a cross-sectional view of the impact rotor 88. The impact rotor 88 is similar to the impact rotor 24 (FIG. 5) except the impact surfaces 90 are angularly positioned such that $\alpha$ is greater than 0°, and a particle of material can not pass between adjacent impact teeth 92. Angularly positioning each impact surface 90 greater than 0° relative to the rotor axis 30 and preventing a particle of material from passing between adjacent impact teeth 92 may be desirable to decrease the number of collisions a particle may have with one or more impact surfaces 90.

Other embodiments are contemplated. For example, each impact surface 90 may be angularly positioned such that a is greater than 0° but canted opposite to the direction shown in FIGS. 6A and 6B. This may be desirable to increase the number of collisions a particle may have with one or more impact surfaces 90.

Figure 7A:
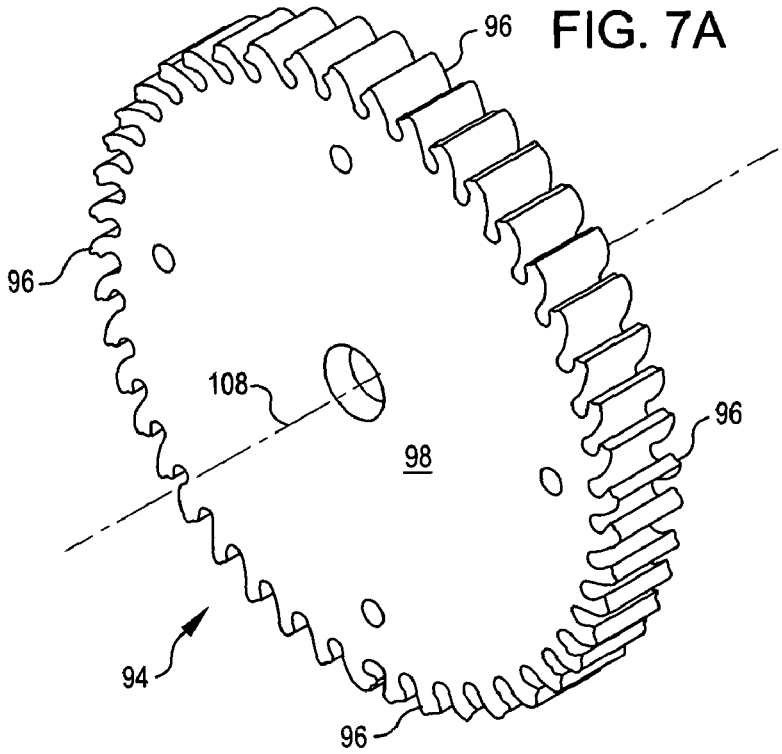
FIG. 7A is a perspective view of an impact rotor, according to still another embodiment of the invention.
Figure 7B:
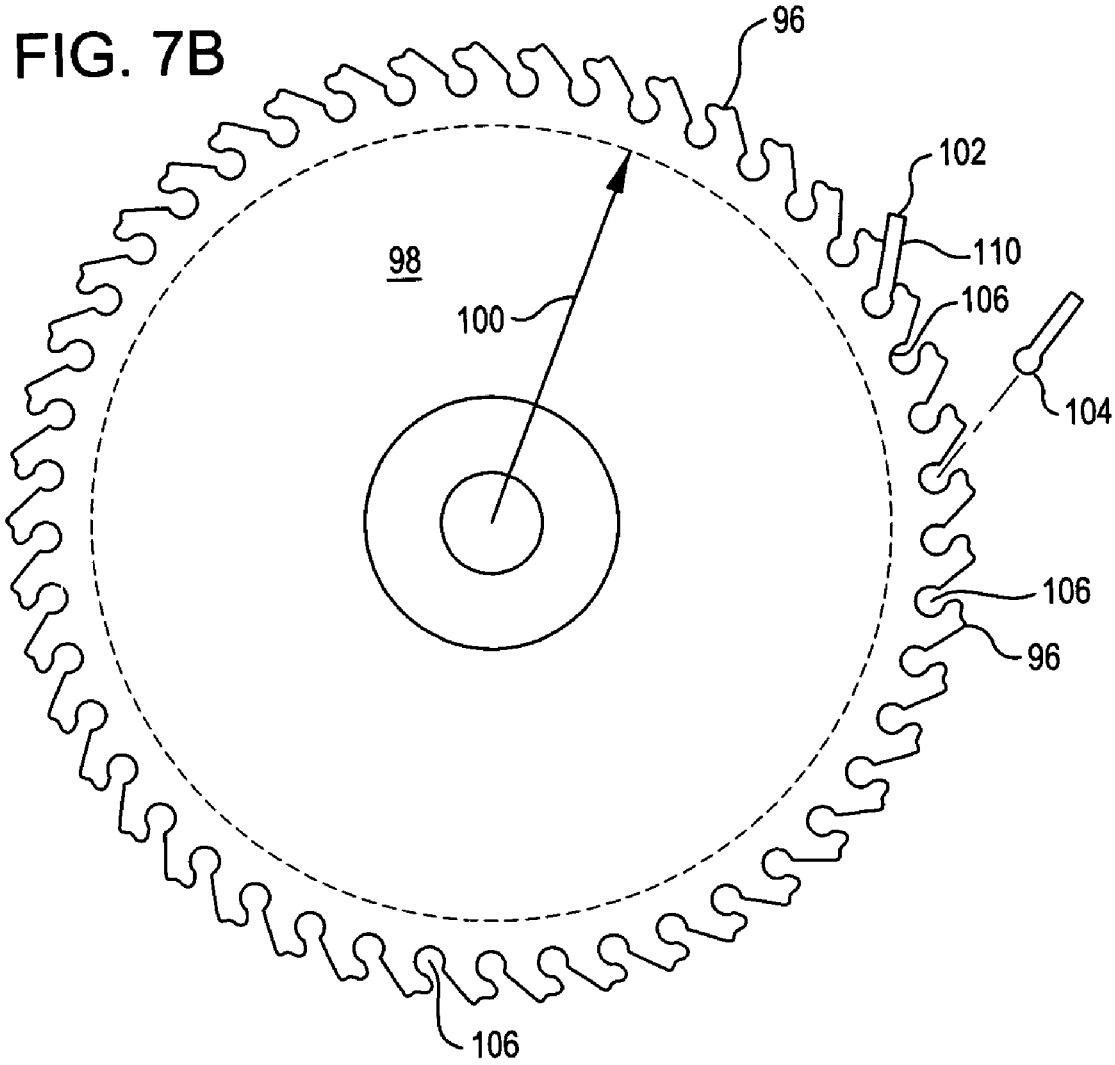
FIG. 7B is a side view of the impact rotor in FIG. 7A.

FIGS. 7A and 7B are views of an impact rotor 94 according to yet another embodiment of the invention. FIG. 7A is a perspective view of the impact rotor 94, and FIG. 7B is a side view of the impact rotor 94. The impact rotor 94 is similar to the impact rotor 22 (FIG. 5) except the impact teeth 96 extend from the body 98 in the same direction as each tooth's respective radius 100. This may be desirable when the impact rotor 94 and throwing wheel 24 (FIG. 3) are not concentric during operation. Each impact plate 102 is mounted on a respective one of the impact teeth 96 by inserting the curved end 104 into a groove 106 and applying adhesive to hold the impact plate 102 to the respective impact tooth 96 in the direction along the rotor axis 108. The impact plate 102 may be mounted such that its impact surface 110 may be facing away from the rotor axis 108 or toward the rotor axis 108, as desired.

Figure 8:
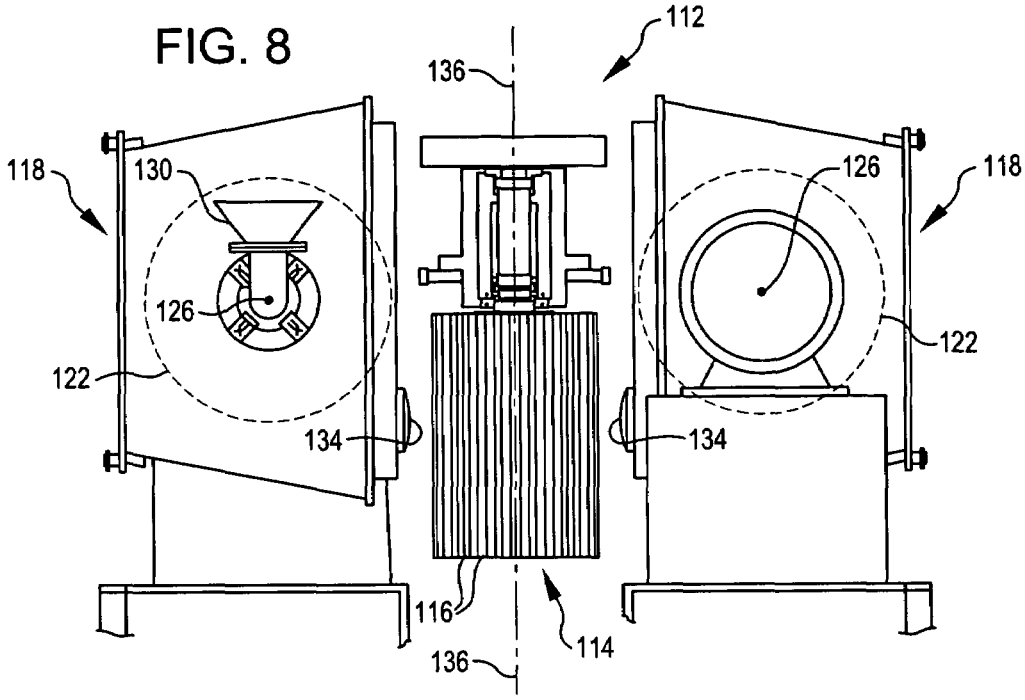
FIG. 8 is a side view of a comminuting device according to another embodiment of the invention.
Figure 9:
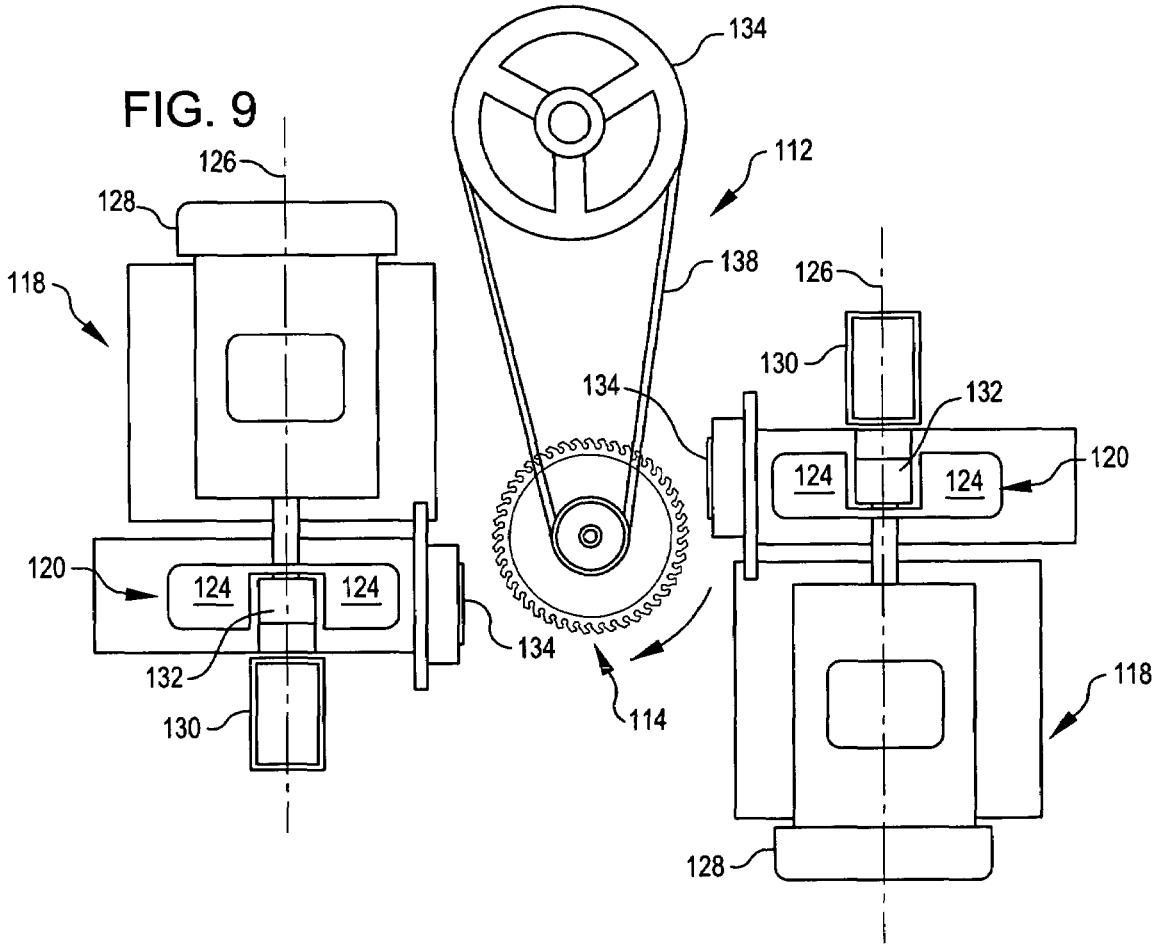
FIG. 9 is a top view of the comminuting device in FIG. 8.

FIGS. 8 and 9 are views of a comminuting device 112 according to another embodiment of the invention. FIG. 8 is a side view of the comminuting device 112, and FIG. 9 is a top view of the comminuting device 112. The comminuting device 112 can efficiently generate impact speeds around 950 ft/sec.

The comminuting device 112 includes an impact rotor 114 that is cylindrical and has impact surfaces 116 to collide with and fracture particles of material, and two particle accelerators 118 to accelerate the particles of material and direct them toward the impact rotor 114. The comminuting device 112 comminutes particles of material by first accelerating the particles with one of the accelerators 118 to an approximate speed of 200–300 ft/sec. Then, the particles are directed toward the impact rotor 114 that rotates to move the impact surfaces 116 at a speed 650 ft/sec or greater toward the particles leaving the accelerators 118. Thus, the comminuting device 112 can generate impact speeds of approximately 850 ft/sec or greater.

In one embodiment, the particle accelerator 118 includes a throwing wheel 120 (shown in FIG. 9 and omitted from FIG. 8 for clarity) having an outer diameter 122 (shown in FIG. 8 and omitted from FIG. 9 for clarity) and blades 124 (shown in FIG. 9 and omitted from FIG. 8 for clarity) that rotate about an axis 126 to accelerate particles of material toward an impact speed, and a motor 128 to rotate the throwing wheel 120. The accelerator 118 also includes a hopper 130 to receive particles of material and feed them to an inlet 132 that is located at the axis 126, and an outlet 134 to direct the particles of material toward the impact rotor 114.

Because the speed of a particle exiting the accelerator 118 largely depends on the throwing wheel's outer diameter 122 and rotational speed, the accelerator 118 may be designed to accelerate particles to any desired exit speed. The exit speed may be substantially determined by multiplying the rotational speed of the throwing wheel 120 times the distance of the particle from the axis 126 (half of the outer diameter 122). Thus, the exit speed may be increased by increasing the throwing wheel's outer diameter 122 and/or rotational speed, and may be decreased by decreasing the throwing wheel's outer diameter 122 and/or rotational speed.

In operation, the accelerator 118 receives particles of material through the hopper 130, which directs the particles toward the inlet 132. Once in the inlet 132, the particles move away from the axis 126 and are picked up and accelerated by a blade 124 of the rotating throwing wheel 120. As the particles' speed increases, centrifugal force moves the particles toward the outer diameter 122 and through progressive regions of the blade 124 whose respective speed increases. Thus, as the particles continue to move toward the outer diameter 122, the blade 124 continues to accelerate the particles toward an impact speed. Then, the outlet 120 receives and directs the particles toward the impact rotor 114.

The impact rotor 114 includes impact surfaces 116 to collide with and fracture the particles of material that have been accelerated by the particle accelerator 118. To increase the impact speed of the particles, a motor 134 (shown in FIG. 9 but omitted in FIG. 8 for clarity) rotates the impact rotor 114 about an axis 136 (shown in FIG. 8 and omitted in FIG. 9 for clarity). A belt 138 couples the motor 134 with the impact rotor 114 to transmit the output power of the motor 134 to the impact rotor 114.

What is claimed is:

1. A device for fragmenting particles, the device comprising:

a throwing wheel rotatable in a first direction and operable to receive the particles for accelerating and directing the particles from a periphery of the throwing wheel along a particle trajectory;

an impact rotor positioned above and having a peripheral impact surface positioned concentrically about the throwing wheel, the peripheral impact surface further comprising a plurality of impact teeth extending therefrom and aligned substantially perpendicular to the particles'trajectory;

the impart rotor rotatable in a second direction opposite to the throwing wheel for increasing an impact speed of the particles and fragmenting the particles when the particles collide with the impact teeth;

a first motor directly coupled to the impact rotor and operable to power the impact rotor, the first motor being mounted above the impact rotor, and a second motor directly coupled to the throwing wheel and operable to power the throwing wheel, the second motor being mounted below the throwing wheel.

2. The device of claim 1 wherein the impact speed of the particles is about 1500 ft/s.

3. The device of claim 1 wherein the impact speed of the particles is 950 ft/s.

4. The device of claim 1 wherein: the throwing wheel rotates about a wheel axis, the impact rotor rotates about a rotor axis, and the wheel and rotor axes are parallel or substantially parallel with each other.

5. The device of claim 1 wherein: the throwing wheel rotates about a wheel axis, the impact rotor rotates about a rotor axis, and the wheel and rotor axes are aligned or substantially aligned with each other.

6. The device of claim 1 wherein the throwing wheel rotates about a wheel axis and includes: a hub through which the wheel axis passes and that is operable to receive particles of material to be accelerated and, a channel operable to direct particles of material from the wheel hub toward a periphery of the wheel, and a wheel exit located at the periphery and through which particles of material pass as the particles leave the throwing wheel.

7. The device of claim 6 wherein the throwing wheel includes 20 channels.

8. The device of claim 1 wherein the impact rotor rotates about a rotor axis and includes: a rotor hub through which the rotor axis passes, and a rotor periphery where the impact surface is located.

9. The device of claim 8 wherein the impact rotor includes 40 impact surfaces.

10. The device of claim 1 further comprising two or more impact rotors.

11. The device of claim 1 wherein the impact teeth are removably mounted to the peripheral impact surface.

12. The device of claim 1 wherein the impact rotor includes 40 impact teeth and each impact tooth includes one impact surface.

13. The device of claim 1 wherein the impact teeth are flat or substantially flat.

* * * * *